US007799382B2

(12) United States Patent
Payne et al.

(10) Patent No.: US 7,799,382 B2
(45) Date of Patent: Sep. 21, 2010

(54) METHOD FOR PRODUCING TOPOGRAPHICAL PATTERN ON PAPERMACHINE FABRIC BY ROTARY SCREEN PRINTING OF POLYMERIC MATERIAL

(75) Inventors: Justin Payne, Blackburn (GB); David Ponton, Blackburn (GB); John Jeffery, Blackburn (GB); Arved Westerkamp, Dettingen/Ems (DE); Antony Morton, Illeley (GB)

(73) Assignee: Voith Paper Patent GmbH, Heidenheim (DE)

( * ) Notice: Subject to any disclaimer, the term of this patent is extended or adjusted under 35 U.S.C. 154(b) by 407 days.

(21) Appl. No.: 11/276,109

(22) Filed: Feb. 14, 2006

(65) Prior Publication Data

US 2006/0182936 A1 Aug. 17, 2006

(30) Foreign Application Priority Data

Feb. 15, 2005 (DE) ..... 10 2005 006 738

(51) Int. Cl.
*B05D 1/28* (2006.01)

(52) U.S. Cl. ..... 427/288; 427/256; 427/428.06; 427/428.18

(58) Field of Classification Search ..... 427/256, 427/288, 428.06, 428.18
See application file for complete search history.

(56) References Cited

U.S. PATENT DOCUMENTS

| | | | | |
|---|---|---|---|---|
| 2,511,511 | A | 6/1950 | Murphy | |
| 3,369,484 | A * | 2/1968 | Cross | 101/38.1 |
| 3,420,167 | A | 1/1969 | Van Der Winden | |
| 4,300,982 | A | 11/1981 | Romanski | |
| 4,384,945 | A * | 5/1983 | Sword | 205/127 |
| 4,514,345 | A | 4/1985 | Johnson et al. | |
| 4,529,480 | A | 7/1985 | Trokhan | |
| 6,203,663 | B1 | 3/2001 | Kamps et al. | |
| 6,287,641 | B1 | 9/2001 | Ostendorf et al. | |
| 6,464,831 | B1 | 10/2002 | Trokhan et al. | |
| 2004/0033743 | A1 * | 2/2004 | Worley et al. | 442/59 |
| 2004/0126544 | A1 * | 7/2004 | Jaglowski et al. | 428/196 |
| 2004/0154774 | A1 | 8/2004 | Rose | |

OTHER PUBLICATIONS

Entry for "screen printing" from Rouette, Hans-Karl, Ed., Encyclopedia of Textile Finishing, Copyright 2001 Woodhead Publishing, p. 23.*

* cited by examiner

*Primary Examiner*—William Phillip Fletcher, III
(74) *Attorney, Agent, or Firm*—Greenblum & Bernstein, P.L.C.

(57) ABSTRACT

A method for producing a topographical pattern on or in a papermachine fabric. The method for creating the pattern on or in an fabric, includes producing a topographical polymer pattern on or in a papermachine fabric using a rotary screen. The instant abstract is neither intended to define the invention disclosed in this specification nor intended to limit the scope of the invention in any way.

22 Claims, 3 Drawing Sheets

METHOD FOR PRODUCING TOPOGRAPHICAL PATTERN ON PAPERMACHINE FABRIC BY ROTARY SCREEN PRINTING OF POLYMERIC MATERIAL

CROSS-REFERENCE TO RELATED APPLICATIONS

The present application claims priority under 35 U.S.C. §119 of German Patent Application No. 10 2005 006 738.7 filed Feb. 15, 2005, the disclosure of which is expressly incorporated by reference herein in its entirety.

BACKGROUND OF THE INVENTION

1. Field of the Invention

The invention relates to a method for producing a topographical pattern on or in a papermachine fabric. It further relates to a corresponding papermachine fabric.

2. Discussion of Background Information

The use of rotary screen printing in the textile industry is well known. Typical examples of rotary screen printing are represented in the U.S. Pat. No. 2,511,511 (Murphy) and U.S. Pat. No. 3,420,167 (Van der Winden). Restrictions in the design and manufacture of rotary screens determine what fabric widths can be processed.

Rotary screens which are supplied by STORK NV are normally implemented in the configuration shown in FIG. 1. End or terminating rings 10, which have a larger diameter than the screens 12 themselves, provide the way by which the screen 12 is fixed and rotated on the machine. During the printing, the fabric has to be present in a width which permits it to run through between the two terminating rings 10 and which allows it direct contact with the screen 12. The actual application width 14 of a rotary screen is therefore always narrower than its entire "machine-width" dimension 16.

STORK NV supplies rotary screens in the following machine widths: 1410, 1750, 1980, 2650, 3050, 3500 and 3800 mm. SAXON SCREENS is a further manufacturer of rotary screens, the maximum available width of these screens being 2080 mm.

Fabrics which are used in the various sections of a paper machine can, however, have widths up to 10 m. Since this is the case, standard rotary screens cannot be used to transfer topographical features over the entire width of the papermachine fabric, specifically because of the screen configuration restrictions described above.

The manufacture of topographical fabrics for the production of decorative paper products is known. For example, U.S. Pat. No. 6,203,663 (Kamps) describes a method for the introduction of a decorative pattern onto a forming fabric by using stitching, stencil printing, printing or weaving techniques. The latter technique of weaving does not permit the production of complex topographical patterns and is more suited to "point patterning", elevated fabric knuckles being used to produce small holes in the paper product. While complex topographical patterns can be achieved by using stitching techniques, the pattern is prone to deterioration as a result of the effects of abrasion. Stencil printing has similar problems to those which are associated with rotary screen printing in relation to the limited screen widths. In order therefore to transfer topographical features to wide papermachine fabrics by this method, it would be necessary for the fabric to be printed section by section over its entire width. The problems inherent in this method are that it is extremely time-consuming and it is necessary to position the stencil screen relative to a previously printed section in such a way that the topographical pattern is aligned and matched accordingly.

U.S. Pat. No. 4,529,480 (Trokhan) teaches a method for manufacturing a woven fabric which has a UV-cured polymer pattern network with deflection conduits. The pattern network and the deflection conduits extend over the entire width of the papermaking fabric width and are designated endless, since it is essentially one unbroken net-like pattern. However, because of restrictions of the process, the UV-cured pattern network has to be applied to the fabric in a batchwise manner or section by section. In addition, the application of a UV-cured section requires a number of different and defined steps, which have to be carried out successively. This particularly complex process has the disadvantages that it is both time-consuming and requires great attention to alignment and matching of the topographical pattern during the sectional application.

SUMMARY OF THE INVENTION

The invention relates to a simple and quick method for producing a durable pattern structure with which paper of improved quality can be produced. By using the method according to the invention, it is possible to apply the pattern structure over the entire width of the papermachine fabric, The invention further relates to a papermachine fabric which has a pattern structure with improved durability and with which paper of improved quality can be produced.

According to a method of the invention, a topographical polymer pattern is produced by a rotary screen. The rotary screen extends only over part of the width of a carrier structure of the fabric. In order to form the topographical polymer pattern on a carrier structure, the rotary screen is moved relative to the carrier structure with respect to the width of the carrier structure. In this way, a plurality of topographical pattern sections of polymer material arranged beside one another are produced on the carrier structure. The movement of the rotary screen relative to the carrier structure is carried out in such a way that the offset between the pattern sections arranged beside one another, at least in the plane of the carrier structure, is 0.1 mm or less.

The papermachine fabric according to the invention is characterized by the fact that, as an external or internal feature, it preferably comprises a topographical polymer pattern produced by a rotary screen. The topographical polymer pattern is preferably produced with respect to the width of the carrier structure by a plurality of topographical pattern sections arranged beside one another on a carrier structure and which, in particular in the plane of the carrier structure, have an offset of 0.1 mm or less from one another.

According to the invention, a topographic pattern structure can be applied simply and accurately to a papermachine fabric by rotary screen discharge head. The application process can be carried out either in an unbroken manner or section by section. In either case, accurate alignment and matching of the topographical pattern is achieved, irrespective of the screen width.

The invention is thus used for the accurate application and incorporation of topographical polymer patterns to the carrier structure of a papermachine fabric. The carrier structure can be woven, as is used for forming and dryer fabric applications, or it could be a nonwoven, as in bonded fabrics or needled felts for press felts. In an exemplary embodiment, the carrier structure is used to carry the polymeric topographical pattern. The carrier structure can have a loadbearing function in the papermachine fabric, such as a woven fabric. Alternatively, the carrier structure can have no loadbearing function, such as a nonwoven.

The topographical pattern can, for example, assume the form of a single motif or of a symmetrical matrix of polymer dots. In either case, the polymer is supplied to the papermachine fabric by a rotary screen which has the motif or the dot pattern engraved in it. The volume of the polymer which is supplied to the papermachine fabric is controlled by the dimensions of the screen motif and also by the polymer pumping system. The penetration of polymer into the fabric is determined by force from behind, which is produced by the pump.

The topographical pattern can be used as an external or internal feature of the papermachine fabric. As an external feature, the topographical pattern forms a part of the side of the fabric that touches the paper. Alternatively, the topographical pattern is applied as an internal feature on the surface of a carrier structure arranged in a press felt, such as a nonwoven. As such, the pattern will lie within the composite structure of the press felt and consequently influence the paper formation during wet pressing.

The invention offers a greater degree of control and reduces the difficulties of other such processes described in the prior art. The invention is characterized by its accurate technological control and repeatability.

According to the invention, a polymer viscosity of greater than 70,000 cP, preferably 100,000 cP to 150,000 cP, is usable. A pattern height above the fabric of 0.05 mm-1.0 mm is provided. A width to height ratio of up to 1:0.7 (silicone), 1:0.5 (polyurethane) is provided. The rotary screen width may be up to 2 m.

The invention provides a topographical pattern matching accuracy or an offset, at least in the plane of the carrier structure, of 0.1 mm or less. The invention also provides total topographical pattern synchronization in relation to the fabric circumference.

According to the invention, the polymer may comprise polyurethane, silicone, polyureas or any combination thereof. Woven papermachine fabrics may be of any weave design and comprise yarns of any type of polymer (polyester, polyamide, etc.). Nonwoven papermaking fabrics can be of any type (needled, spun bonded, linked, etc.) and comprise fibers or yarns of any polymer type (polyester, polyamide, etc.).

One advantage of the invention resides in the ability to choose whether the topographical pattern is applied either in a semi continuous (i.e., section by section) or continuous (i.e., spiral) mode. In each mode, the polymer is supplied uninterruptedly to the rotary screen, which in turn transfers it on to the fabric.

In semi continuous operation, the first stage must supply an initial section over the entire circumference of the fabric. The rotary screen is then indexed to a position where it will apply the second section. The control and the degree of screen movement are such that the accurate pattern matching occurs within the tolerance of 0.1 mm or less in relation to the initial section. The process is continued in this way until the entire width of the papermachine fabric is covered with the topographical pattern. An additional advantage of the semi continuous operation is that the rotary screen can be changed before the application of a section. It is therefore possible to have a large number of topographical patterns on one papermachine fabric.

In the continuous operating mode, the entire width of the papermachine fabric is covered with the topographical pattern in one operation. The continuous operating mode is achieved by traversing the rotary screen slowly relative to the fabric, so that the pattern is applied in a spiral manner. The spiral angular movement of the fabric is determined by a number of interconnected process parameters, which comprise the fabric circumference, the fabric width, the fabric speed, the screen circumference, the screen pitch and the screen speed. The high level of process control during the continuous (spiral) operation permits accurate pattern matching, which can occur within a tolerance of only 0.1 mm.

Topographical pattern matching is an important and unique feature of this invention and is important for maintaining quality standards during the papermaking operation. Topographical pattern matching relates both to the continuous and to the discontinuous forms of motif and dot design. In the case of continuous designs, the emphasis is placed on maintaining a net-like pattern. In the case of the non-continuous designs, the emphasis is placed on maintaining the screen pitch spacing between the motifs or dots.

The invention provides an accurate topographical pattern application and pattern matching system. A continuous or non-continuous application of a pattern to a papermachine fabric for use in the production of decorative tissue or decorative paper is disclosed. Accurate matching of the topographical pattern, in order to ensure and to maintain the quality of the decorative tissue or decorative paper, is achievable.

In an exemplary embodiment, there is an application to the paper side of a forming fabric in order to produce watermark effects by redistributing paper fiber orientation during sheet formation. According to another exemplary embodiment, there is an application to the paper side or within a press felt in order to produce decorative paper effects during the wet pressing process is described. Different topographical patterns may be applied to a fabric in order to produce a plurality of decorative effects in a paper product.

According to the invention, there is a method for creating a patterned fabric, comprising producing a topographical polymer pattern on or in a papermachine fabric using a rotary screen. The rotary screen extends only over part of a width of a carrier structure of the papermachine fabric and the producing comprises moving the rotary screen relative to the carrier structure in such a way that, with respect to the width of the carrier structure, the topographical polymer pattern is formed by a plurality of topographical pattern sections arranged beside one another which, at least in a plane of the carrier structure, have an offset of 0.1 mm or less.

The method comprises supplying a polymer to the papermachine fabric via the rotary screen. The rotary screen comprises an engraved topographical pattern. The rotary screen has a width of up to 2 m.

According to the method, the volume of the polymer supplied to the papermachine fabric is controllable by dimensions of a rotary screen pattern and by a polymer pumping system. The polymer may be supplied continuously to the rotary screen. A viscosity of the polymer is greater than 70,000 cP, and preferably in a range from about 100,000 cP to about 150,000 cP. The polymer comprises at least one of: polyurethane, silicone, polyureas.

The topographical polymer pattern may be produced in a form of a single motif. The topographical polymer pattern may be produced in a form of a symmetrical matrix of polymer dots. The topographical polymer pattern may be produced continuously along a spiral path. The topographical polymer pattern may be produced while maintaining a net-like pattern. The topographical polymer pattern may be produced section by section.

A pattern height above the papermachine fabric lies in a range from 0.05 mm to 1.0 mm. A ratio between pattern width and pattern height for a polymer composed of silicone is in a range up to 1:0.7. A ratio between pattern width and pattern height for a polymer composed of polyurethane is in a range up to 1:0.5.

According to the invention, there is a papermachine fabric comprising a fabric having a topographical polymer pattern formed as an external or internal feature. The topographical polymer pattern comprises a plurality of topographical pattern sections arranged beside one another on a carrier structure.

The topographical polymer pattern may comprise a single motif. The topographical polymer pattern may comprise a symmetrical matrix of polymer dots. The topographical polymer pattern may comprise a net-like pattern.

The polymer viscosity is greater than 70,000 cP, and preferably the polymer viscosity lies in a range from about 100,000 cP to about 150,000 cP. A pattern height above the papermachine fabric lies in a range from 0.05 mm to 1.0 mm. The topographical polymer pattern comprises a polymer comprising at least one of: polyurethane, silicone, and polyureas. The polymer may comprise silicone and a ratio between pattern width and pattern height lies in a range up to 1:0.7. The polymer may comprise polyurethane and a ratio between pattern width and pattern height lies in a range up to 1:0.5.

The fabric may comprise: a woven fabric; yarns composed of a polymer; a nonwoven material; a wet felt and the topographical polymer pattern is arranged on a surface of a base fabric and within a structure of the wet felt; a needled, spun bonded, or linked structure; fibers or yarns composed of a polymer; a forming fabric; and a press felt.

The topographical polymer pattern is produced by a rotary screen. The topographical polymer pattern may be arranged as an external feature. The topographical pattern sections have an offset from one another of 0.1 mm or less with respect to a width of the carrier structure and at least in a plane of the carrier structure. The papermachine fabric may comprise a different topographical polymer pattern formed as an external or internal feature.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
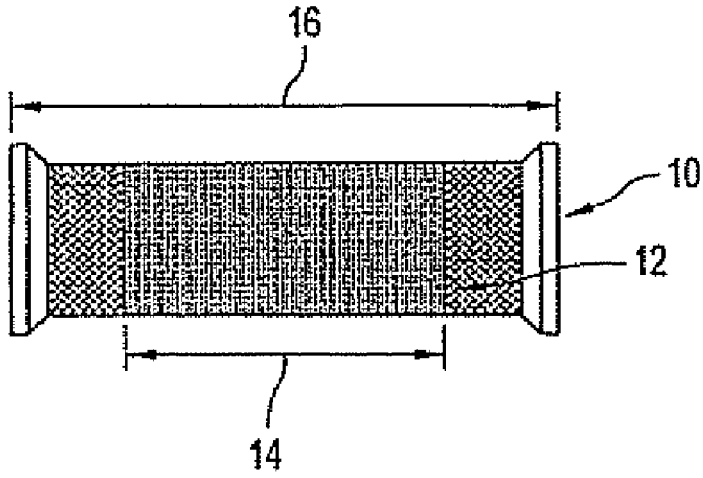
Fig.1 Prior Art
FIG. 1 shows a conventional configuration of a rotary screen.
Figure 2:
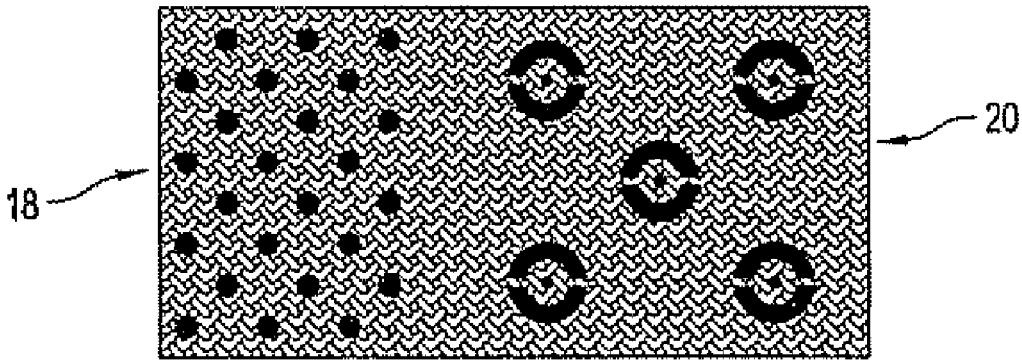
FIG. 2 shows two exemplary embodiments of the invention with a topographical pattern in the form of a dot pattern and a topographical pattern in the form of a motif pattern.

FIG. 2 shows two exemplary embodiments of the invention with a topographical pattern in the form of a dot pattern 18 and a topographical pattern in the form of a motif pattern 20.

The topographical pattern 18, 20 can therefore assume the form of a unique motif or a symmetric matrix of polymer dots, for example. The polymer is supplied to the carrier structure through a rotary screen, which has the motif or the dot pattern engraved in it. The volume of the polymer which is supplied to the papermachine fabric is controlled by the dimensions of the screen motif and also by the polymer pumping system. The penetration depth of the polymer into the carrier structure of the fabric is also affected by the force generated by the pumping, which forces the polymer through the rotary screen.

The topographical pattern can be used as an external or internal feature of the papermachine fabric. The topographical pattern is used as an external feature in order to influence the paper formation on the paper side of the fabric. Alternatively, the topographical pattern is applied, for example, as an internal feature on the surface of the carrier structure of a press felt, the carrier structure being located within the composite structure of the press felt and consequently influencing the paper formation by using wet pressing.

Figure 3:
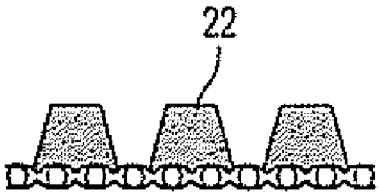
FIG. 3 shows an exemplary embodiment of the invention with a topographical pattern on the surface of a woven papermachine fabric.

FIG. 3 shows an exemplary embodiment of the invention with a topographical pattern 22 on the paper side of a woven papermachine fabric, such as a forming fabric.

Figure 4:
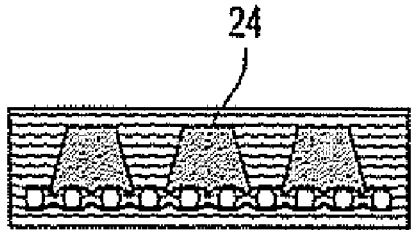
FIG. 4 shows an exemplary embodiment of the invention with a topographical pattern on the surface of a woven base fabric and in the structure of a wet felt.

FIG. 4 shows an exemplary embodiment of the invention with a topographical pattern 24 on the surface of a woven fabric and therefore loadbearing carrier structure and in the structure of a wet felt.

Figure 5:
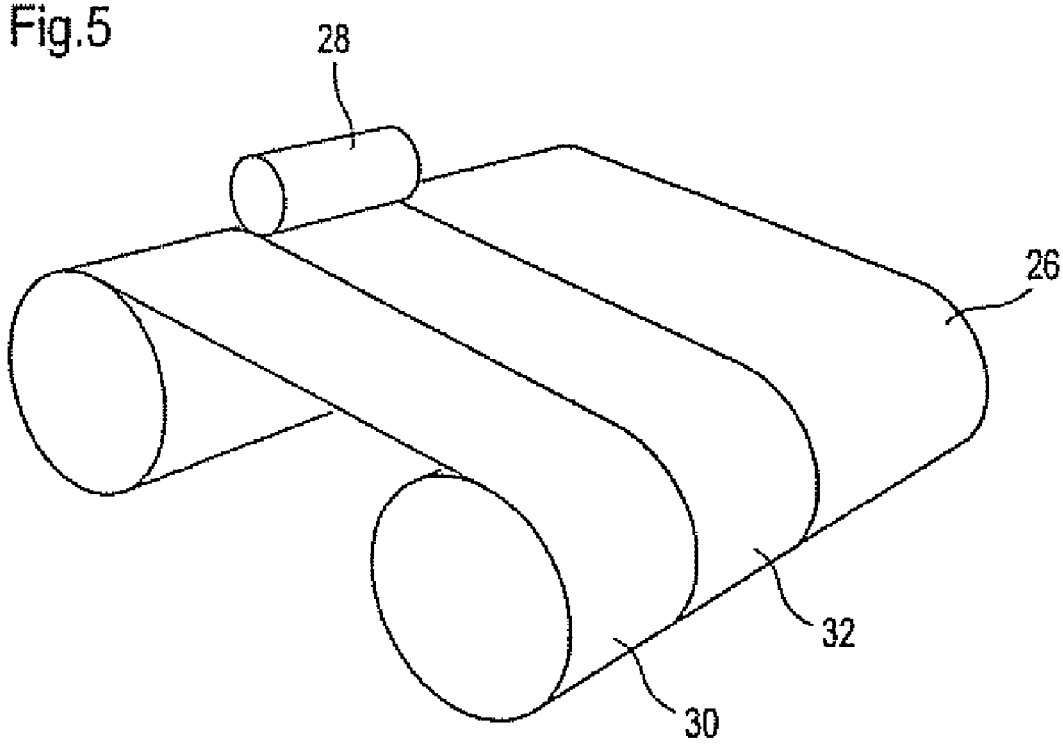
FIG. 5 shows an exemplary embodiment of the invention with respect to the application of the topographical pattern by the semi continuous method (i.e., section by section)

FIG. 5 shows an exemplary embodiment of the invention with respect to the application of the topographical pattern by the semi continuous method, in which in each case pattern sections arranged beside one another are formed, each on its own forming an endless closed loop in the circumferential direction of the carrier structure. Following the formation of each section, the rotary screen 28 is moved forward by the width of this section before the next section is applied to the carrier structure 26. In FIG. 5, an initial section is designated "30" and a second section is designated "32".

Figure 6:
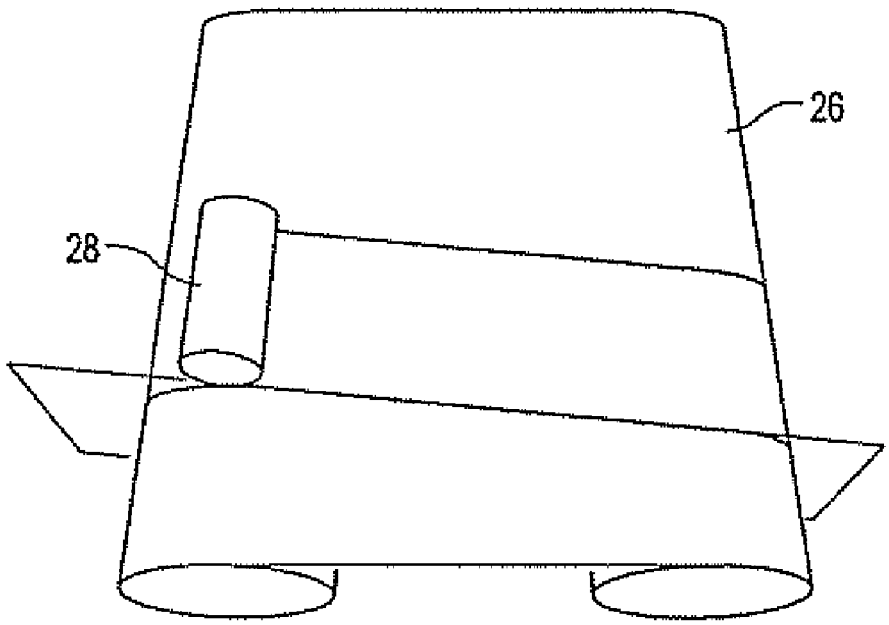
FIG. 6 shows an exemplary embodiment of the invention with respect to the application of the topographical pattern by the continuous method (i.e., in the form of a spiral)

FIG. 6 shows an exemplary embodiment of the invention with respect to the application of the topographical pattern by the continuous method, that is to say in the form of a spiral. In the continuous operating mode, the entire width of the papermachine fabric 26 is covered with the topographical pattern in one operation. The continuous operating mode is achieved by traversing the rotary screen 28 slowly relative to the fabric, so that the pattern is applied in a spiral way. The spiral angular movement of the screen is determined by a number of interconnected process parameters, which comprise the fabric circumference, the fabric width, the fabric speed, the screen size, the screen pattern pitch and the screen speed. The high degree of process control during the continuous spiral operation permits accurate pattern matching, which can only occur within a tolerance of 0.1 mm. In FIG. 6, the papermachine fabric 26 and the rotary screen 28 which completes a spiral angular movement can be seen.

The topographical pattern matching is an important and unique feature of the invention and is essential to maintaining quality standards during the papermaking operation. The topographical pattern matching relates both to the continuous and to the non-continuous motif and dot designs.

Figure 7:
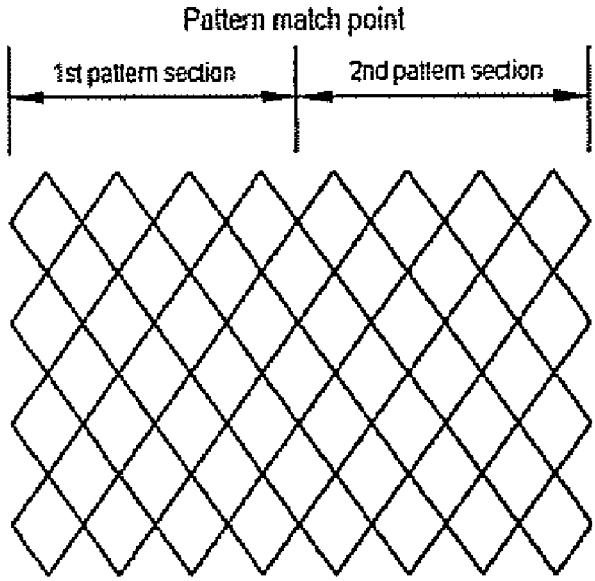
FIG. 7 shows an exemplary embodiment of the invention for a continuous design in plan view of the plane of a carrier structure.

FIG. 7 shows a plan view of the plane of a carrier structure for a continuous design. In this case, a first pattern section and a second pattern section as well as the pattern match point can be seen. The offset of the two pattern sections in the plane of the carrier structure is 0.1 mm or less. Furthermore, the vertical offset of the two pattern sections, that is to say the offset at right angles to the plane of the carrier structure, is 0.1 mm or less. In the case of the continuous designs, the emphasis is placed on maintaining a net-like pattern.

Figure 8:
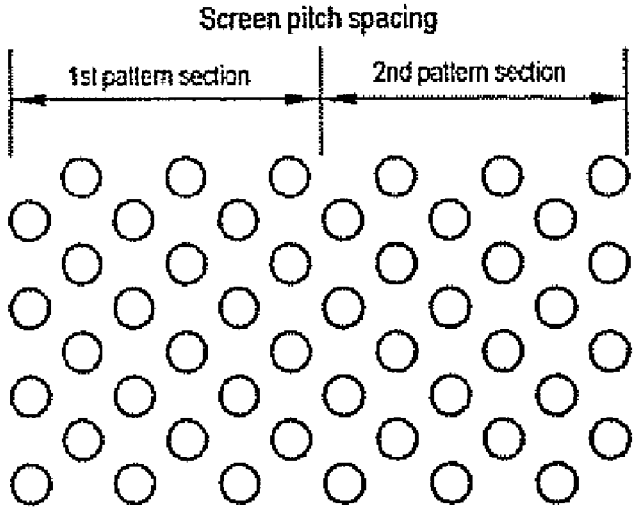
FIG. 8 shows an exemplary embodiment of the invention for a non-continuous design in plan view of the plane of a carrier structure.

FIG. 8 shows an exemplary embodiment of the invention for a non-continuous design. In this case, a first pattern section and a second pattern section and a screen pitch spacing can be seen in FIG. 8. In the case of the non-continuous designs, the emphasis is placed on maintaining the screen pitch spacing between the motifs or dots. In this example, the offset of the two pattern sections in the plane of the carrier structure is 0.1 mm or less.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

| List of designations | |
|---|---|
| 10 | End ring, terminating ring |
| 12 | Screen |
| 14 | Application width |
| 16 | Machine width |
| 18 | Dot pattern, topographical pattern |
| 20 | Motif pattern, topographical pattern |
| 22 | Topographical pattern |
| 24 | Topographical pattern |
| 26 | Papermachine fabric |
| 28 | Rotary screen |
| 30 | Initial section |
| 32 | Second section |

What is claimed:

1. A method for creating a patterned fabric, comprising:

producing a topographical polymer pattern on or in a papermachine fabric using a rotary screen, wherein the rotary screen extends only over part of a width of a carrier structure of the papermachine fabric; and the producing comprises moving the rotary screen relative to the carrier structure with respect to the width of the carrier structure such that the topographical polymer pattern is formed by a plurality of topographical pattern sections arranged beside one another.

2. The method as claimed in claim 1, wherein the topographical pattern sections arranged beside one another have, at least in a plane of the carrier structure, an offset of 0.1 mm or less.

3. The method as claimed in claim 1, wherein the producing comprises supplying a polymer to the papermachine fabric via the rotary screen.

4. The method as claimed in claim 3, wherein the rotary screen comprises an engraved topographical pattern.

5. The method as claimed in claim 3, wherein a volume of the polymer supplied to the papermachine fabric is controllable by dimensions of a rotary screen pattern and by a polymer pumping system.

6. The method as claimed in claim 1, wherein the topographical polymer pattern is produced in a form of a single motif.

7. The method as claimed in claim 1, wherein the topographical polymer pattern is produced in a form of a symmetrical matrix of polymer dots.

8. The method as claimed in claim 1, wherein the topographical polymer pattern is produced continuously.

9. The method as claimed in claim 8, wherein the topographical polymer pattern is produced along a spiral path.

10. The method as claimed in claim 8, wherein the topographical polymer pattern is produced while maintaining a net-like pattern.

11. The method as claimed in claim 1, wherein the topographical polymer pattern is produced section by section.

12. The method as claimed in claim 3, wherein the polymer is supplied continuously to the rotary screen.

13. The method as claimed in claim 3, wherein a viscosity of the polymer is greater than 70,000 cP.

14. The method as claimed in claim 13, wherein the viscosity lies in a range from about 100,000 cP to about 150,000 cP.

15. The method as claimed in claim 1, wherein a pattern height above the papermachine fabric lies in a range from 0.05 mm to 1.0 mm.

16. The method as claimed in claim 1, the producing comprises using a polymer that comprises at least one of: polyurethane, silicone, polyureas.

17. The method as claimed in claim 16, wherein a ratio between pattern width and pattern height for a polymer composed of silicone is in a range up to 1:0.7.

18. The method as claimed in claim 16, wherein a ratio between pattern width and pattern height for a polymer composed of polyurethane is in a range up to 1:0.5.

19. The method as claimed in claim 1, wherein the rotary screen has a width of up to 2 m.

20. A method for creating a patterned fabric, comprising:

producing a topographical polymer pattern on or in a papermachine fabric using a rotary screen, wherein the topographical pattern is produced continuously such that the entire width of the papermachine fabric is covered with the topographical pattern in one operation by traversing the rotary screen relative to the papermachine fabric so that the topographical pattern is applied in a spiral manner.

21. The method as claimed in claim 20, wherein spiral movement of the rotary screen relative to the papermachine fabric is determined by interconnected process parameters comprising at least one of: papermachine fabric circumference, papermachine fabric width, papermachine fabric speed, rotary screen circumference, rotary screen pitch, and rotary screen speed.

22. The method as claimed in claim 20, wherein spiral movement of the rotary screen relative to the papermachine fabric is determined based on: papermachine fabric circumference, papermachine fabric width, papermachine fabric speed, rotary screen circumference, rotary screen pitch, and rotary screen speed.

* * * * *